US006336798B1

(12) United States Patent
Ohtake et al.

(10) Patent No.: US 6,336,798 B1
(45) Date of Patent: Jan. 8, 2002

(54) ROTATION PREVENTING MECHANISM FOR SCROLL-TYPE FLUID DISPLACEMENT APPARATUS

(75) Inventors: Shinichi Ohtake, Ashikaga; Jiro Iizuka, Takasaki; Akiyoshi Higashiyama, Gunma, all of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/693,865

(22) Filed: Oct. 23, 2000

(30) Foreign Application Priority Data

Nov. 4, 1999 (JP) ..... 11-314359

(51) Int. Cl.[7] ..... F01C 1/04
(52) U.S. Cl. ..... 418/55.3; 464/103
(58) Field of Search ..... 418/55.3; 464/103

(56) References Cited

U.S. PATENT DOCUMENTS

| | | | | |
|---|---|---|---|---|
| 3,647,268 | A | 3/1972 | Haines | 308/193 |
| 4,259,043 | A | 3/1981 | Hidden et al. | 418/55.3 |
| 4,406,600 | A | 9/1983 | Terauchi et al. | 418/55.3 |
| 4,457,674 | A | 7/1984 | Kawano et al. | 418/55.3 |
| 4,457,676 | A | 7/1984 | Hiraga | 418/57 |
| 4,468,181 | A | 8/1984 | Sakamoto | 418/55.3 |
| 4,472,120 | A | 9/1984 | McCullough | 418/83 |
| 4,474,543 | A | 10/1984 | Hiraga et al. | 418/55.3 |
| 4,492,543 | A | 1/1985 | Iimori et al. | 418/55.3 |
| 4,527,963 | A | 7/1985 | Terauchi | 418/55.6 |
| 4,545,746 | A | 10/1985 | Sugimoto et al. | 418/55.3 |
| 4,589,828 | A | 5/1986 | Sato et al. | 418/55.3 |
| 4,626,179 | A | 12/1986 | Terauchi | 418/55.2 |
| 4,645,435 | A | 2/1987 | Sugimoto | 418/55.3 |
| 4,934,909 | A | 6/1990 | Suzuki et al. | 418/55.3 |
| 5,102,315 | A | 4/1992 | Terauchi et al. | 418/55.3 |
| 5,221,198 | A | 6/1993 | Izumi et al. | 418/55.3 |
| 5,423,663 | A | 6/1995 | Fukui | 418/55.3 |
| 5,435,706 | A | 7/1995 | Matsumoto et al. | 418/55.3 |
| 5,738,504 | A | 4/1998 | Kitano | 418/55.3 |
| 5,911,566 | A | 6/1999 | Terauchi et al. | 418/55.3 |
| 5,915,933 | A | 6/1999 | Iizuka et al. | 418/55.3 |
| 6,139,293 | A | 10/2000 | Iizuka et al. | 418/55.3 |
| 6,149,412 | A | 11/2000 | Kikuchi | 418/55.3 |
| 6,158,991 | A | 12/2000 | Ohtake et al. | 418/55.3 |
| 6,200,115 | B1 | 3/2001 | Kikuchi | 418/55.3 |
| 6,206,665 | B1 | 3/2001 | Iizuka | 418/55.3 |

FOREIGN PATENT DOCUMENTS

| | | | |
|---|---|---|---|
| EP | 0049881 | 4/1982 | |
| EP | 0123407 | 10/1984 | |
| FR | 2455196 | 4/1980 | |
| JP | 63179185 | 7/1988 | 418/55.3 |
| JP | 63266214 | 11/1988 | |
| JP | 5033811 | 2/1993 | |
| JP | 587131 | 4/1993 | |
| JP | 5126140 | 5/1993 | |
| JP | 7019249 | 1/1995 | |
| JP | 9310685 | 12/1997 | |

*Primary Examiner*—John J. Vrablik
(74) *Attorney, Agent, or Firm*—Baker Botts L.L.P.

(57) ABSTRACT

A scroll-type compressor includes a fixed and an orbiting scroll each having an end plate. A ball coupling means preventing the orbiting scroll from rotating, includes a first race and a second race and a plurality of balls. The balls are engaged between ball rolling grooves on the first race and ball rolling grooves on the second race. Each of an interior circular portion and an exterior circular portion of the first race and the second race is connected to the orbiting scroll and the front housing. Each of a clearance is created between the first race and the orbiting scroll, and between the second race and the front housing. The structure for the scroll-type compressor according to this invention may reduce the number of parts compared to known scroll-type compressor, and may maintain stability of an orbital motion of an orbiting scroll, when thrust load is high.

4 Claims, 7 Drawing Sheets

ROTATION PREVENTING MECHANISM FOR SCROLL-TYPE FLUID DISPLACEMENT APPARATUS

BACKGROUND OF THE INVENTION

1. Field of the Invention

The present invention relates to a rotation preventing mechanism for a scroll-type fluid displacement apparatus.

2. Description of Related Art

Scroll-type fluid displacement apparatus are known in the art. For example, Japanese Patent Application No. 10-44821 describes the construction of the scroll-type fluid displacement apparatus shown in FIG. 1.

The scroll-type fluid displacement apparatus includes two scroll members—an orbiting scroll and a fixed scroll, each having an end plate, and a spiroidal or involute spiral wrap element extending from one side of each end plate. The scroll members are maintained at an angular and radial offset, so that both spiral elements interfit to form a plurality of line contacts between their spiral curved surfaces to thereby seal off and define at least one pair of fluid pockets. The relative orbital motion of the two scroll members shifts the line contacts along the spiral curved surfaces and, as a result, changes the volume of the fluid pockets. The volume of the fluid pockets increases or decreases depending on the direction of orbital motion. Thus, this scroll-type apparatus is able to compress, expand, or pump fluids.

Referring to FIG. 1, at least a pair of fluid pockets 103 are formed between fixed scroll 101 and orbiting scroll 102. When orbiting scroll 102 is driven with an orbital motion relative to fixed scroll 101, fluid pockets 103 are moved to the center with a consequent reduction in volume, and refrigerant gas confined within fluid pockets 103 is compressed. Ball coupling 115, which prevents orbiting scroll 102 from rotating and transfers thrust load from orbiting scroll 102 to front housing 106, includes first race 116, ball rolling grooves 116*a*, second race 117, ball rolling grooves 117*a*, balls 118. First race 116, which is ring-shaped and is fixed to orbiting scroll 102, includes a plurality of ball rolling grooves 116*a* formed on a circumference thereof at an angular interval. Second race 117, which is ring-shaped and is fixed to front housing 106, includes a plurality of ball rolling grooves 117*a* formed on a circumference thereof at an angular interval. A plurality of balls 118 are positioned between ball rolling grooves 116*a* and ball rolling grooves 117*a*. An interior circular portion of first race 116 contacts an interior circular portion of an end plate of orbiting scroll 102, and a clearance is created between an exterior circular portion of the end plate of orbiting scroll 102 and an exterior circular portion of first race 116. An exterior circular portion of second race 117 contacts an exterior circular portion of an end surface of front housing 106, and a clearance is created between an interior circular portion of front housing 106 and an interior circular portion of second race 117.

In this known compressor, front housing 106 and rear housing 104 are assembled, such that first race 116 and second race 117 are elastically deformed like a coned disk spring, which is a circular plate spring having a hole in the center portion. Therefore, elasticity is created between first race 116 and second race 117, and a connecting force toward the x-axis is generated between fixed scroll 101 and orbiting scroll 102. As a result, a spacer, which is inserted between front housing 106 and rear housing 104 to generate an appropriate force between fixed scroll 101 and orbiting scroll 102, may be no longer required, and the number of parts of the compressor may be reduced.

In this known compressor, however, first race 116 and second race 117 are supported like cantilever. Therefore, when the thrust load, which is transferred from orbiting scroll 102 to front housing 106 through ball coupling 115, increases, the amount of elastic deformation of first race 116 and second race 117 may become excessive. As a result, rolling of balls 118 may lose stability, and the orbiting motion of orbiting scroll 102 may become unstable. Therefore, in this known compressor, the efficiency of compression may be reduced, and wear may occur because a clearance between a top end of a spiral wall of fixed scroll 101 and a top end of a spiral wall of orbiting scroll 102 may increase or decrease.

SUMMARY OF THE INVENTION

An object of the present invention is to provide a scroll-type fluid displacement apparatus which includes fewer parts than known configurations, and maintains stability of the orbital motion of an orbiting scroll during high thrust load.

In an embodiment, a ball coupling component for use in a scroll-type fluid displacement apparatus comprises a first race and a second race and a plurality of balls. The first race is fixed to a second side of an end plate of an orbiting scroll. The second race is fixed to an end surface of a front housing, which opposes the second side of the end plate of the orbiting scroll. The balls are positioned between a plurality of ball rolling grooves formed on a circumference of the first race at an angular interval and a plurality of ball rolling grooves formed on a circumference of the second race. An interior circular portion and an exterior circular portion of the first race is connected to the second side of the end plate of the orbiting scroll. A clearance is created between the ball rolling grooves of the first race and the end plate of the orbiting scroll. An interior circular portion and an exterior circular portion of the second race is connected to the end surface of the front housing. A clearance is created between the ball rolling grooves of the second race and the end surface of the front housing.

In another embodiment, a scroll-type fluid displacement apparatus comprises a rear housing and a front housing, a fixed scroll and an orbiting scroll, a driving mechanism, and a ball coupling. The rear housing has an open end and an inlet port and outlet port. A front housing closes the opening of the rear housing. The fixed scroll has a first end plate and a spiral element formed on and extending from a first side of the first end plate. The fixed scroll is attached to the rear housing. The orbiting scroll has a second end plate and a spiral element formed on and extending from a first side of the second end plate. Each of the spiral elements interfits at an angular and a radial offset to form a plurality of line contacts defining at least one pair of sealed-off fluid pockets. A driving mechanism includes a drive shaft rotatably supported by the front housing to effect the orbital motion of the orbiting scroll by rotation of the drive shaft to thereby change the volume of the fluid pockets. A disk-shaped eccentric bushing is rotatably connected to a crank pin on a disk, which is formed integrally with the drive shaft. A radial bearing is fitted into an annular boss formed on the second side of the end plate of the orbiting scroll and receives the disk-shaped eccentric bushing. A ball coupling includes an first race fixed to the second side of the end plate of the orbiting scroll and a second race fixed to an end surface of the front housing and a plurality of balls. The first race and the second race face each other. The balls are positioned between a plurality of all rolling grooves formed on a circumference of the first race at an angular interval and a plurality of ball rolling grooves formed on a circumference of the second race at an angular interval. An interior circular portion and an exterior circular portion of the first race are connected to the second side of the end plate of the orbiting scroll. A clearance is created between the ball rolling grooves of the first race and the second side of the end plate of the orbiting scroll. An interior circular portion and an exterior circular portion of the second race are connected to the end surface of the front housing. A clearance is created between the ball rolling grooves of the second race and the end surface of the front housing.

The structure for the scroll-type fluid displacement apparatus according to this invention may no longer require a spacer, which is inserted between the front housing and the rear housing to generate an appropriate force between the fixed scroll and the orbiting scroll, and the number of the parts of the scroll-type fluid apparatus may be reduced. Further, the structure for the scroll-type fluid displacement apparatus according to this invention may permit stable movement of the orbiting scroll in an orbital motion.

Other objects, features, and advantages will be apparent to persons of ordinary skill in the art from the following detailed description of the invention and the accompanying drawings.

BRIEF DESCRIPTION OF THE DRAWINGS

The present invention may be more readily understood with reference to the following drawings, in which.

DETAILED DESCRIPTION OF PREFERRED EMBODIMENTS

Figure 1:
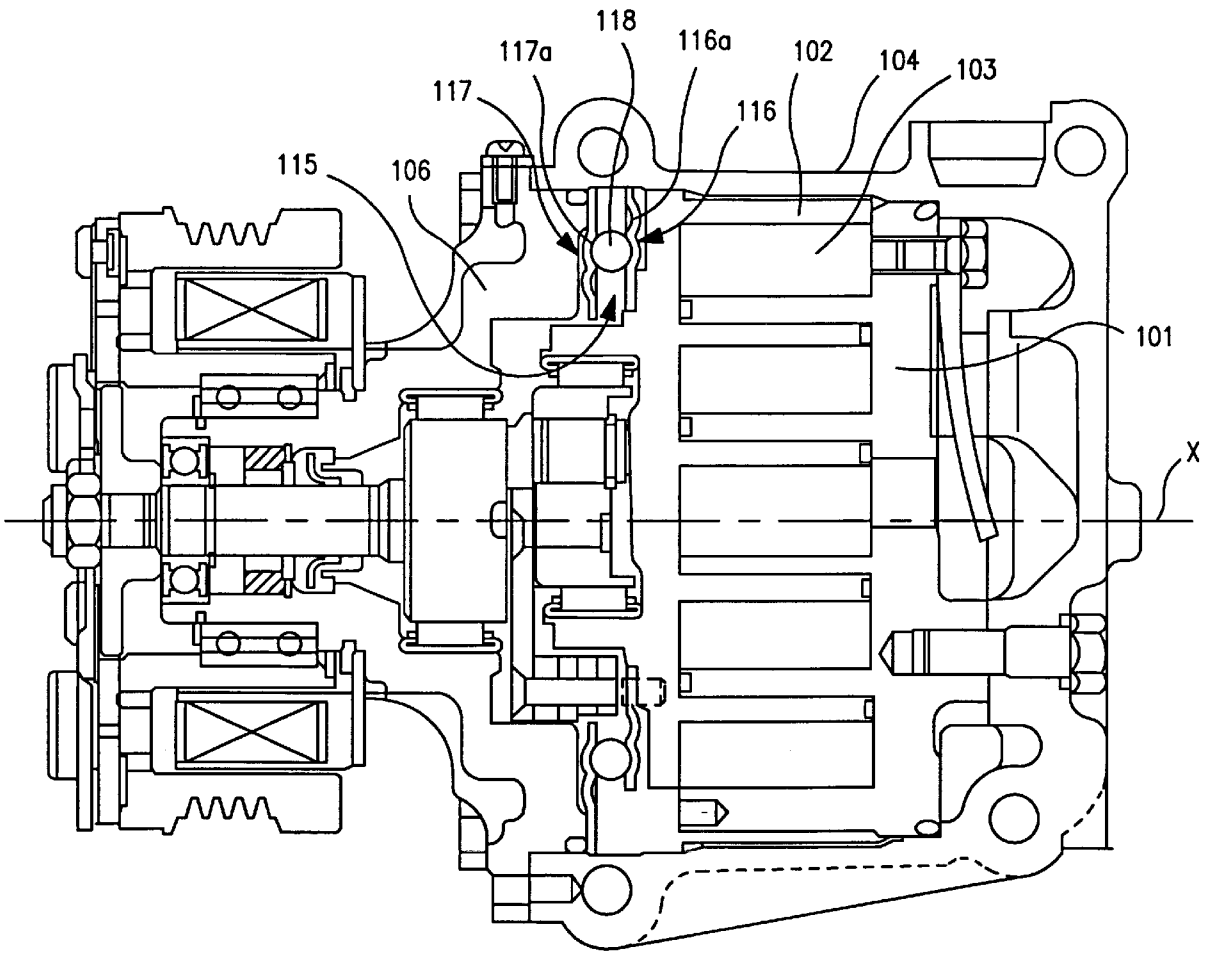
FIG. 1 (Prior Art)
FIG. 1 is a longitudinal, cross-sectional view of a known scroll-type fluid displacement apparatus.
Figure 2:
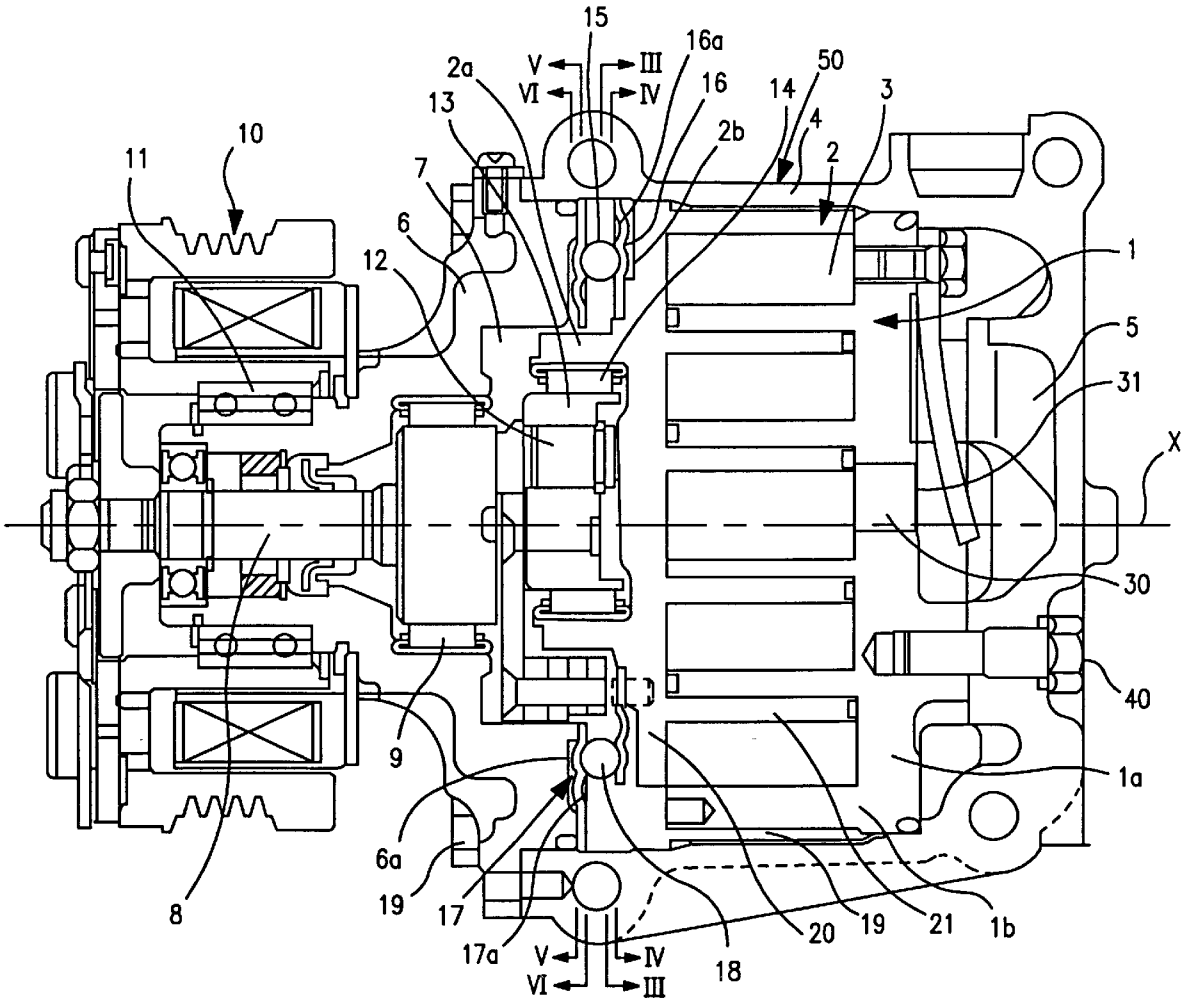
FIG. 2 is a longitudinal, cross-sectional view of a scroll-type fluid displacement apparatus in accordance with an embodiment of the present invention.

Referring to FIG. 2, scroll-type compressor includes housing 50 and fixed scroll 1 and orbiting scroll 2. Housing 50 comprises cup-shaped rear housing 4 and front housing 6.

Fixed scroll 1 is located in rear housing 4. Fixed scroll 1 is secured to rear housing 4 by a plurality of bolts 40. Discharge chamber 5 is formed in rear housing 4 behind fixed scroll 1. Fixed scroll 1 includes disk-shaped first end plate 1*a* and first spiral element 1*b*. First spiral element 1*b* has discharge port 30, which is formed through first end plate 1*a* at a position near the center of first spiral element 1*b*. First spiral element 1*b* extends from the first end surface of first end plate 1*a*, which is opposite side of discharge chamber 5. First end plate 1*a* of fixed scroll 1 divides the inner chamber of rear housing 4 into suction chamber 19 and discharge chamber 5. An inlet port (not shown) is formed on rear housing 4, and communicates with suction chamber 19. An outlet port (not shown) is formed on rear housing 4, and communicates with discharge chamber 5.

Orbiting scroll 2 is located in rear housing 4. Orbiting scroll 2 includes disk-shaped second end plate 20 and second spiral element 21, which extends from the first end surface of second end plate 20, and annular boss 2*a*, which is formed on and axially projects from the second end surface of second end plate 20. First spiral element 1*a* of fixed scroll 1 and second spiral element 21 of orbiting scroll 2 interfit at an angular offset of about 180 degrees and a predetermined radial offset. At least a pair of fluid pockets 3 are defined between fixed scroll 1 and orbiting scroll 2.

Front housing 6 is secured to rear housing 4 from the side of orbiting scroll 2 by a plurality of bolts 19. Crank chamber 7 is formed in front housing 6 behind orbiting scroll 2.

Drive shaft 8 is disposed on a central axis of front housing 6 and rear housing 4 (i.e., the x-axis), and located in crank chamber 7. Drive shaft 8 is rotatably supported by front housing 6 through radial bearing 9. One end of drive shaft 8 projects from front housing 6. Electromagnetic clutch 10 is rotatably supported by front housing 6 through radial bearing 11. Crank pin 12 is connected eccentrically to another end of drive shaft 8. Crank pin 12 is inserted into annular boss 2*a* of orbiting scroll 2, and is inserted into a disk-shaped eccentric bushing 13. Eccentric bushing 13 is rotatably disposed in the annular boss 2*a* through radial bearing 14.

Figure 3:
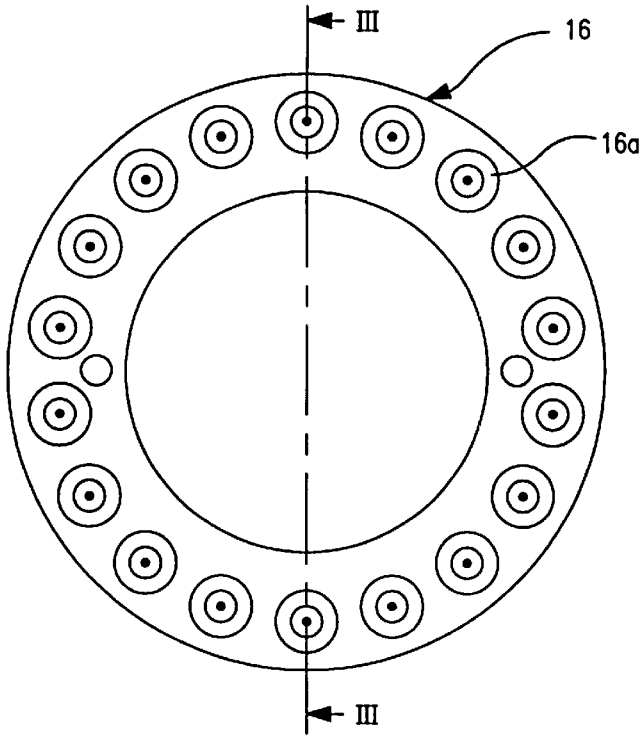
FIG. 3 is a cross-sectional view taken along the line III—III of FIG. 2.
Figure 4:
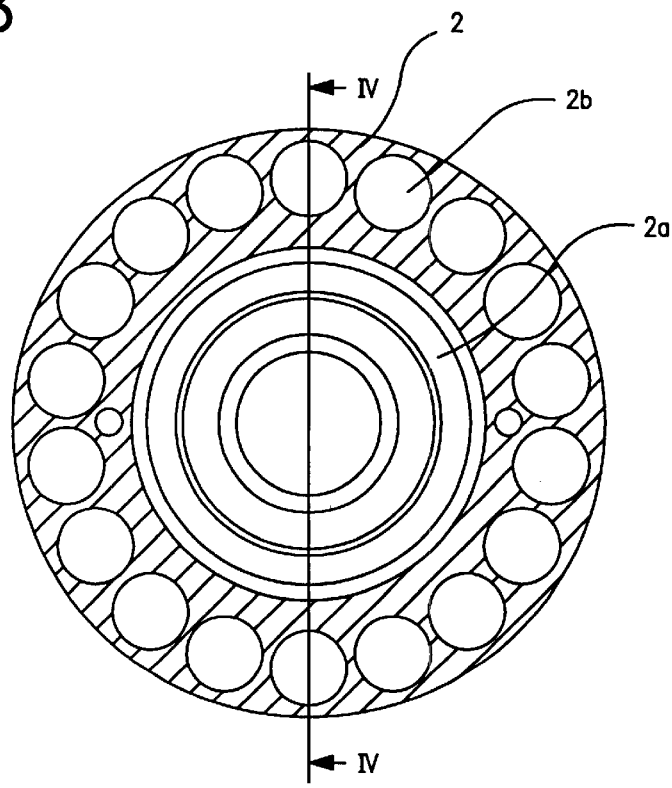
FIG. 4 is a cross-sectional view taken along the line IV—IV of FIG. 2.

Ball coupling 15, which prevents orbiting scroll 2 from rotating and transfers thrust load from orbiting scroll 2 to front housing 6, comprises first race 16 and second race 17 and a plurality of balls 18. Ball coupling 15 is disposed between second end plate 20 of orbiting scroll 2 and an end surface of front housing 6. As shown in FIGS. 2 and 3, ball coupling 15 has ring-shaped first race 16, which is secured to the second surface of second end plate 20 of orbiting scroll 2 by a plurality of screws. A plurality of ball rolling grooves 16*a* are formed on a circumference of first race 16 at an angular interval. An interior circular portion and an exterior circular portion of first race 16 are connected to the second surface of second end plate 20 of orbiting scroll 2. As shown in FIGS. 2 and 4, a plurality of circular-shaped recess portions 2*b*, whose diameters are larger than that of ball rolling grooves 16*a*, are formed on the second surface of second end plate 20 of orbiting scroll 2. Recess portions 2*b* correspond to a plurality of ball rolling grooves 16*a* of first race 16. Referring again to FIG. 2, a clearance is created between one surface of first race 16 and the second surface of second end plate 20 of orbiting scroll 2.

Figure 5:
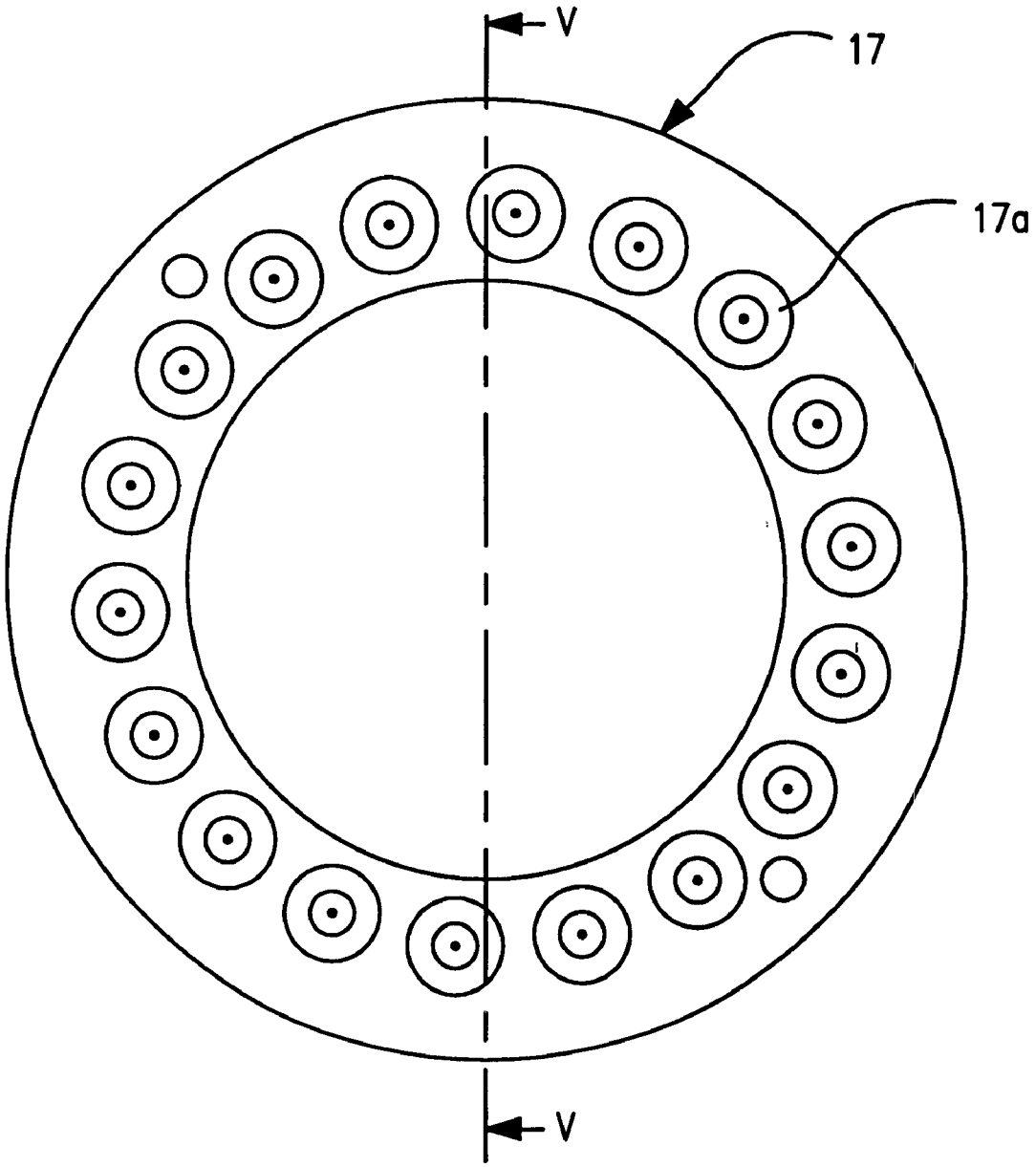
FIG. 5 is a cross-sectional view taken along the line V—V of FIG. 2.
Figure 6:
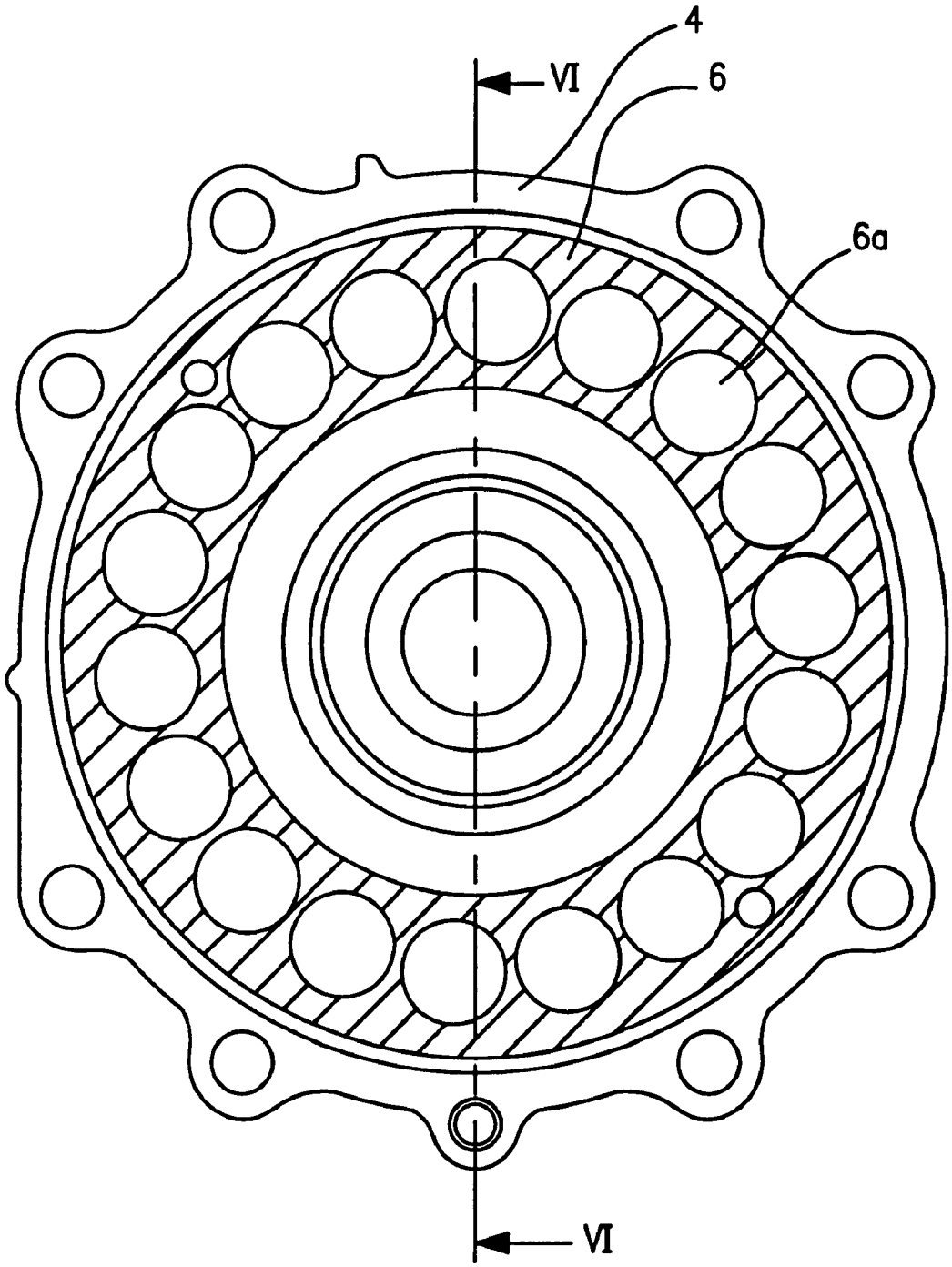
FIG. 6 is a cross-sectional view taken along the line VI—VI of FIG. 2.

As shown in FIGS. 2 and 5, ball coupling 15 has ring-shaped second race 17, which is secured to an end surface of front housing 6 by a plurality of screws. A plurality of ball rolling grooves 17*a* are formed on a circumference of second race 17 at an angular interval. An interior circular portion and an exterior circular portion of second race 17 are connected to the end surface of front housing 6. As shown in FIGS. 2 and 6, a plurality of circular-shaped recess portions 6*a*, whose diameters are larger than those of ball rolling grooves 17*a*, are formed on the end surface of front housing 6 corresponding to a plurality of ball rolling grooves 17*a* of second race 17. Referring again to FIG. 2, a clearance is created between a first surface of second race 17 and the end surface of front housing 6.

As shown in FIG. 2, ball coupling 15 has a plurality of balls 18, which are engaged between ball rolling grooves 16*a* of first race 16 and ball rolling grooves 17*a* of second race 17.

The rotation of orbiting scroll 2 is prevented by a rotation preventing mechanism, i.e., ball coupling 15, which is disposed between the second surface of second end plate 20 of orbiting scroll 2 and the end surface of front housing 6 and around annular boss 2*a* of orbiting scroll 2.

When a driving force is transferred from an external driving source (e.g. an engine of a vehicle) via electromagnetic clutch 10, drive shaft 8 is rotated, and orbiting scroll 2, which is supported by crank pin 12, is driven in an orbital motion around the x-axis by the rotation of drive shaft 8. Ball coupling 15 prevents the rotation of orbiting scroll 2 with respect to fixed scroll 1. When orbiting scroll 2 is driven in an orbital motion, fluid pockets 3, which are defined between first spiral element 1*b* of fixed scroll 1 and second spiral element 21 of orbiting scroll 2, move from the outer or peripheral portions of spiral elements to the center part of the spiral elements. Refrigerant gas, which enters suction chamber 19 through an inlet port (not shown), flows into one of fluid pockets 3. When fluid pockets 3 move from the outer portions of the spiral element to the center part of the spiral element, the volume of fluid pockets 3 is reduced, and refrigerant gas in fluid pockets 3 is compressed. Compressed refrigerant gas confined within fluid pockets 3 moves to discharge port 30, displaces a reed valve 31, and is discharged through discharge port 30 into discharge chamber 5. Finally, the compressed refrigerant gas is discharged into an external refrigerant circuit (not shown) through an outlet port (not shown).

In this invention of a scroll-type fluid displacement apparatus, front housing 6 and rear housing 4 are assembled, such that an adjacent portion of ball rolling grooves 16*a* of first race 16 is elastically deformed toward inside of a circular-shaped recess portions 2*b* of second end plate 20 of orbiting scroll 2 and an adjacent portion of ball rolling grooves 17*a* of second race 17 is elastically deformed toward inside of a circular-shaped recess portions 6*a* of the end surface of front housing 6. Therefore, elasticity is created between first race 16 and second race 17, and a connecting force toward the x-axis is generated between fixed scroll 1 and orbiting scroll 2. As a result, a spacer, which is inserted between front housing 6 and rear housing 4 to generate an appropriate force between fixed scroll 1 and orbiting scroll 2, may no longer be required, and the number of parts of the compressor may be reduced.

An interior circular portion and an exterior circular portion of first race 16 are connected to the second surface of second end plate 20 of orbiting scroll 2. An interior circular portion and an exterior circle portion of second race 17 are connected to the end surface of front housing 6. Both first race 16 and second race 17 are supported at interior circular and exterior circular portions thereof. Therefore, when the thrust load, which is transferred from orbiting scroll 2 to front housing 6 through ball coupling 15, is increased, the amount of elastic deformation of first race 16 and second race 17 may not be excessive. As a result, rolling of balls 18 may maintain stability, and orbiting scroll 2 may stably move in an orbital motion, when the thrust load is high.

Figure 7A:
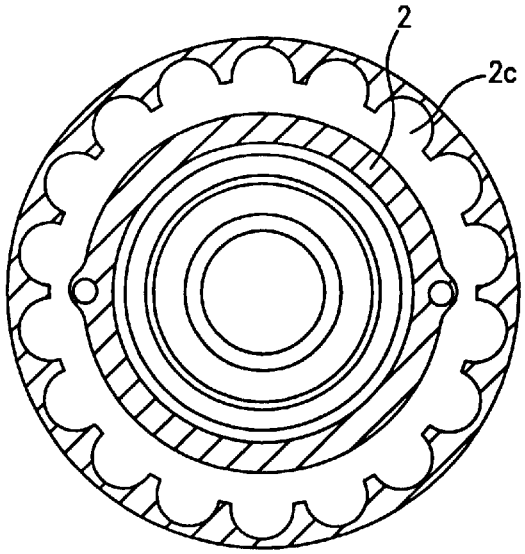
FIGS. 7*a–b* depict other embodiments of the scroll-type fluid displacement apparatus, which relate to the depiction of FIG. 4.
Figure 7B:
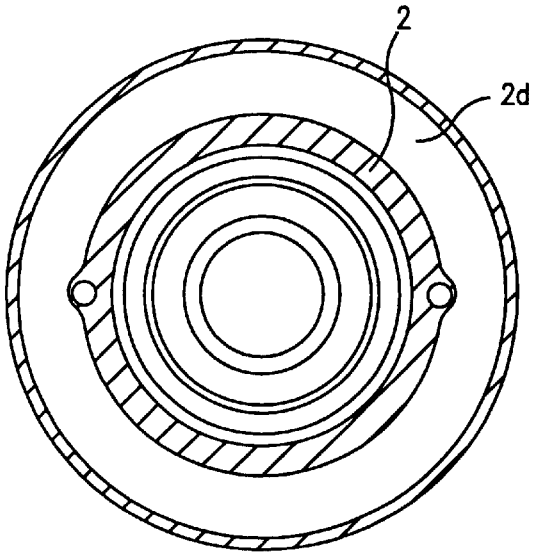
Figure 8A:
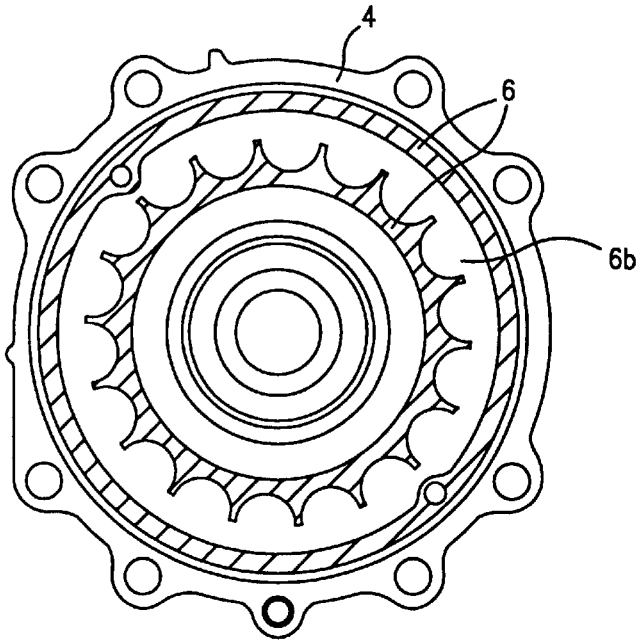
FIGS. 8*a–b* depict other embodiments of the scroll-type fluid displacement apparatus, which relate to the depiction of FIG. 6.
Figure 8B:
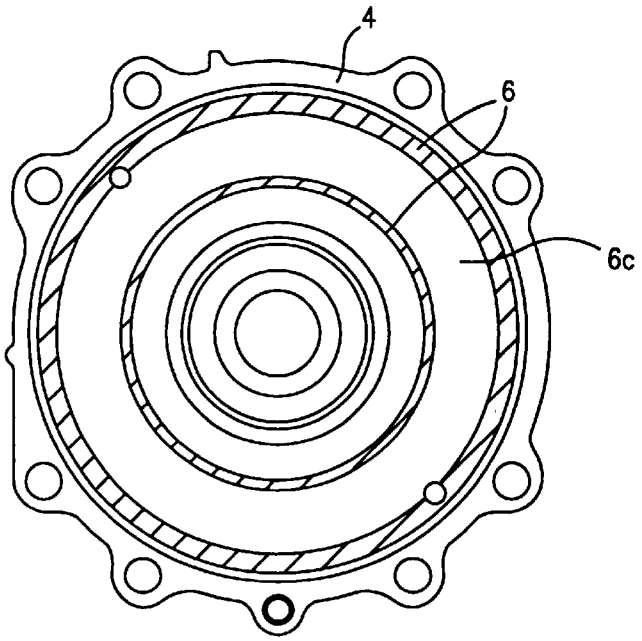

In above-described apparatus, a plurality of a circular-shaped recess portions 2*b* are formed on the second surface of second end plate 20 of orbiting scroll 2 corresponding to a plurality of ball rolling, grooves 16*a* of first race 16, and a plurality of circular-shaped recess portions 6*a* are formed on the end surface of front housing 6 corresponding to a plurality of ball rolling grooves 17*a* of second race 17. However, as shown in FIGS. 7*a–b*, forming a single, circular-shaped recess portion 2*c* or 2*d* on the second surface of second end plate 20 of orbiting scroll 2 corresponding to a plurality of ball rolling grooves 16*a* of first race 16 is within scope of the present invention. Similarly, as shown in FIGS. 8*a–b*, forming a single, circular-shaped recess portion 6*b* or 6*c* on the end surface of front housing 6 corresponding to a plurality of ball rolling grooves 17*a* of second race 17 is within scope of the present invention.

As described above, with respect to embodiments of the present invention of a scroll-type fluid apparatus, front housing 6 and rear housing 4 are assembled, such that an adjacent portion of ball rolling grooves 16*a* of first race 16 is elastically deformed toward inside of single circular-shaped recess portions 2*c* or 2*d* of the second surface of end plate 20 of orbiting scroll 2 and an adjacent portion of ball rolling grooves 17*a* of second race 17 is elastically deformed toward inside of single circular-shaped recess portions 6*b* or 6*c* of the end surface of front housing 6. Therefore, elasticity is created between first race 16 and second race 17, and a connecting force toward the x-axis is generated between fixed scroll 1 and orbiting scroll 2. As a result, a spacer, which is inserted between front housing 6 and rear housing 4, may be no longer required, and the number of parts of the scroll-type fluid apparatus may be reduced.

An interior circular portion and an exterior circular portion of first race 16 are connected to the second surface of end plate 20 of orbiting scroll 2. An interior circular portion and an exterior circular portion of second race 17 are connected to the end surface of front housing 6. Both first race 16 and second race 17 are supported at interior circular and exterior circular portion thereof. Therefore, when the thrust load, which is transferred from orbiting scroll 2 to front housing 6 through ball coupling 15, is increased, the amount of elastic deformation of first race 16 and second race 17 may not be excessive. As a result, rolling of balls 18 may maintain stability, and orbiting scroll 2 may stably move in an orbital motion.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A ball coupling component for use in a scroll-type fluid displacement apparatus comprising:

a first race fixed to a second side of an end plate of an orbiting scroll;

a second race fixed to an end surface of a front housing, said second race opposing said second side of said end plate of said orbiting scroll; and a plurality of balls positioned between a plurality of ball rolling grooves formed on a circumference of said first race at an angular interval and a plurality of ball rolling grooves formed on a circumference of said second race at an angular interval;

wherein an interior circular portion and an exterior circular portion of said first race are connected to said end plate of said orbiting scroll, and a clearance is created between the entire portion of said first race opposite said ball rolling grooves of said first race and said end plate of said orbiting scroll, and wherein an interior circular portion and an exterior circular portion of said second race are connected to said end surface of said front housing, and a clearance is created between the entire portion of said second race opposite said ball rolling grooves of said second race and said end surface of front housing.

2. The ball coupling component of claim 1, wherein a plurality of recess portions are formed on one side of said end plate of said orbiting scroll that correspond to a plurality of said ball rolling grooves formed on said first race, wherein a plurality of recess portions are formed on said end surface of said front housing that correspond to a plurality of said ball rolling grooves formed on said second race.

3. The ball coupling component of claim 1, wherein a single, circular-shaped recess portion is formed on said second side of said end plate of said orbiting scroll that corresponds to a plurality of said ball rolling grooves formed on said first race, wherein a single, circular-shaped recess portion is formed on said end surface of said front housing that corresponds to a plurality of said ball rolling grooves formed on said second race.

4. A scroll-type fluid displacement apparatus comprising;

a rear housing having an open end and an inlet port and outlet port;

a front housing closing said open end;

a fixed scroll having a first end plate and a spiral element formed on and extending from a first side of said first end plate, and attached to said rear housing;

an orbiting scroll member, having a second end plate and a spiral element formed on and extending from a first side of said second end plate, each of said spiral elements interfitting at an angular and a radial offset to form a plurality of line contacts defining at least one pair of sealed-off fluid pockets; and a driving mechanism including a drive shaft rotatably supported by said front housing to effect the orbital motion of said orbiting scroll member by rotation of said drive shaft to thereby change the volume of said fluid pockets, a disk-shaped eccentric bushing rotatably connected to a crank pin on a disk which is formed integrally with said drive shaft, and a radial bearing fitted into an annular boss formed on a second side of said end plate of said orbiting scroll and receiving said disk-shaped eccentric bushing, a ball coupling means preventing said orbiting scroll from rotating, including a first race fixed to said second side of said end plate of said orbiting scroll and a second race fixed to an end surface of said front housing, said first race and said second race facing each other, and including a plurality of balls, said balls positioned between a plurality of ball rolling grooves formed on a circumference of said first race at an angular interval and a plurality of ball rolling grooves formed on a circumference of said second race at an angular interval;

wherein an interior circular portion and an exterior circular portion of said first race are connected to said second side of said end plate of said orbiting scroll, and a clearance is created between the entire portion of said first race opposite said ball rolling grooves of said first race and said second side of said end plate of said orbiting scroll, and wherein an interior circular portion and an exterior circular portion of said second race are connected to said end surface of said front housing, and a clearance is created between the entire portion of said second race opposite said ball rolling grooves of said second race and said end surface of front housing.

* * * * *